US006871586B2

(12) United States Patent
Teraoka

(10) Patent No.: US 6,871,586 B2
(45) Date of Patent: Mar. 29, 2005

(54) SLIDE DRIVE APPARATUS AND SLIDE DRIVE METHOD FOR PRESSING MACHINE

(75) Inventor: Kenichi Teraoka, Kanazawa (JP)

(73) Assignees: Komatsu Ltd., Tokyo (JP); Komatsu Industries Corp., Tokyo (JP)

( * ) Notice: Subject to any disclaimer, the term of this patent is extended or adjusted under 35 U.S.C. 154(b) by 0 days.

(21) Appl. No.: 10/252,860

(22) Filed: Sep. 23, 2002

(65) Prior Publication Data

US 2003/0066332 A1 Apr. 10, 2003

(30) Foreign Application Priority Data

Oct. 10, 2001 (JP) ..... 2001-313316

(51) Int. Cl.[7] ..... B30B 15/14

(52) U.S. Cl. ..... 100/49; 100/99; 100/257; 100/282; 100/283; 100/289; 72/450; 72/454

(58) Field of Search ..... 100/257, 280, 100/282, 283, 286, 285, 214, 231, 272, 99, 49, 50, 289; 72/448, 450, 451, 454, 455; 83/530, 632; 71/441

(56) References Cited

U.S. PATENT DOCUMENTS 3,687,069 A * 8/1972 Helrigel et al. ..... 100/257
4,033,252 A * 7/1977 Baker ..... 100/99
4,034,666 A * 7/1977 Bigun et al. ..... 100/231
4,095,522 A * 6/1978 Drungil ..... 100/214
4,364,257 A * 12/1982 Endo et al. ..... 72/405.03
5,349,902 A * 9/1994 Daniel et al. ..... 100/48
5,445,072 A * 8/1995 Yagi et al. ..... 100/48
6,012,322 A * 1/2000 Itakura ..... 72/450
6,148,720 A * 11/2000 Yoshida ..... 100/257
6,247,399 B1 * 6/2001 Yoshida ..... 100/257

FOREIGN PATENT DOCUMENTS

JP 3-29036 Y2 6/1991

* cited by examiner

*Primary Examiner*—Allen Ostrager
*Assistant Examiner*—J Nguyen
(74) *Attorney, Agent, or Firm*—Frishauf, Holtz, Goodman & Chick, P.C.

(57) ABSTRACT

A slide drive apparatus and a slide drive method for a pressing machine capable of enhancing positioning precision at the time of adjustment of die height, and responding to pressing work at high stroke per minute. For this purpose, the drive apparatus includes a slide (4), a servo motor (21) for controlling slide motion, a mechanical power transmission mechanism (3, 5, 6) for converting rotational power of the servo motor for controlling slide motion into reciprocating motion of the slide, and a servo motor (31) for adjusting die height, which performs die height adjustment of the slide by a position control.

10 Claims, 7 Drawing Sheets

SLIDE DRIVE APPARATUS AND SLIDE DRIVE METHOD FOR PRESSING MACHINE

TECHNICAL FIELD

The present invention relates to a slide drive apparatus and a slide drive method for a pressing machine.

BACKGROUND ART

Since a temperature difference occurs to a each component frame while a pressing machine is used, the die height is changed, and when high product precision is required, the change in die height has a large influence on the product precision. Recently, there are more and more products that require very high product precision, and this problem becomes important. For such a change in die height, a die height adjusting apparatus is conventionally proposed, and the one disclosed in, for example, Japanese Utility Model Application Publication No. 3-29036 is known. FIG. 7 is a block diagram of a die height adjusting apparatus described in Japanese Utility Model Application Publication No. 3-29036.

In FIG. 7, a slide 4 is connected to a plunger 19 operated in a vertical direction via an adjusting screw 41, and by rotating the adjusting screw 41, the position of the slide 4 is made adjustable with respect to the plunger 19. A worm wheel 78 is concentrically fixed to the adjusting screw 41, and a worm 79 is meshed with the worm wheel 78. Two ratchet wheels 81 and 82, both having a number of claws, each of which is in an unequal-sided angled shape where one side of the claw is a catching surface, are fixed to a shaft of the worm 79, with the catching surfaces of the claws on the respective ratchet wheels facing in the opposite direction to each other. The tip ends of piston rods 85 and 86 of cylinder devices 83 and 84 oppose the side of the catching surfaces of the claws of the respective ratchet wheels 81 and 82 in the extension direction of the piston rods 85 and 86. Further, cylinder chambers of the cylinder devices 83 and 84 are connected to a fluid pressure source 89 such as a reservoir via solenoid valves 87 and 88.

However, in the above-described die height adjusting apparatus disclosed in Japanese Utility Model Application Publication No. 3-29036, the ratchet wheels 81 and 82 are driven in normal and reverse rotation by the cylinder devices 83 and 84 to rotate the adjusting screw 41 via the worm 79 and the worm wheel 78, and therefore, responsiveness is not so good. Consequently, the positioning precision, at the time of adjustment of the die height, cannot be made so high, thus making it very difficult to apply the apparatus to the products requiring high precision. In addition, the die height adjustment requires much time, and therefore this arises the disadvantage that the apparatus cannot respond to press working at high stroke per minute of, for example, 300 SPM or more, when the die height adjustment is performed for each press stroke, during slide operation, and at the time when working is not performed.

SUMMARY OF THE INVENTION

The present invention is made in view of the above-described disadvantage, and has its object to provide a slide drive apparatus and a slide drive method for a pressing machine capable of enhancing positioning precision at the time of adjustment of die height and responding to pressing work at high stroke per minute.

In order to attain the above-described object, a slide drive apparatus for a pressing machine according to the present invention has a constitution including a slide, a servo motor for controlling slide motion, a mechanical power transmission mechanism for converting rotational power of the servo motor for controlling slide motion into reciprocating motion of the slide, and a servo motor for adjusting die height, which performs die height adjustment of the slide by a position control.

According to the above constitution, since the die height adjustment is performed by a position control of the servo motor, responsiveness of control becomes very good, die height adjustment can be performed with very high precision, and the product precision can be enhanced dramatically. Since the die height adjustment is completed in a short time, the apparatus can easily respond to a slide operation at high stroke per minute.

Further, in the slide drive apparatus for the pressing machine, the die height adjustment of the slide may be performed during a slide motion control of the servo motor for controlling slide motion. According to the above constitution, the die height adjustment is performed by the position control of the servo motor during a slide motion control, and therefore the die height adjustment can be performed at high precision, thus making it possible to enhance product precision dramatically and easily respond to a slide operation at high stroke per minute. Further, the die height adjustment is performed during a slide motion control, and thus a high speed operation at high stroke per minute of, for example, 300 SPM or higher, which has been conventionally difficult to respond to, can be easily performed.

Further, in the slide drive apparatus for the pressing machine, the die height adjustment of the slide may be performed for each slide stroke. According to the above constitution, die height adjustment is performed for each slide stroke, and therefore pressing work can be always performed in a state in which the die height is kept highly precise, thus making it possible to surely produce the product with high precision without variations.

Further, in the slide drive apparatus for the pressing machine, the power transmission mechanism may comprise a link mechanism. According to the above constitution, a servo motor rotational power is converted into slide reciprocating motion via the link mechanism, and therefore it is not necessary to receive large load directly with the servo motor, in addition to the fact that large pressurization force can be easily obtained with comparatively small torque. In addition, link motion suitable for molding work and cutting work can be easily realized. Further, the slide can be continuously operated by the continuous rotation of the servo motor in one direction, and therefore the drive control of the servo motor during continuous operation is easy.

Furthermore, in the slide drive apparatus for the pressing machine, the power transmission mechanism may comprise an eccentric mechanism. According to the above constitution, the rotational power of the servo motor is converted into slide reciprocating motion via the eccentric mechanism, and therefore it is not necessary to receive large load directly with the servo motor, and the conversion mechanism can be made simple.

Further, in the slide drive apparatus for the pressing machine, the power transmission mechanism may comprise a ball screw mechanism. According to the constitution, the rotating power of the servo motor is converted into the reciprocating motion of the slide via the ball screw mechanism, and therefore it is not necessary to receive large load directly with the servo motor, and the conversion mechanism can be made simple.

A slide drive method for a pressing machine according to the present invention has the constitution including the step of performing a position control of a servo motor for adjusting die height during driving of the slide to perform die height adjustment of the slide.

According to the above constitution, since the die height adjustment is performed by the position control of the servo motor during driving of the slide, the die height adjustment can be performed with very high precision, and the product precision can be enhanced dramatically. Further, even when the slide drive source is not a servo motor, but, for example, a DC motor, an AC motor or the like, if the position control of the servo motor for adjusting the die height is performed by receiving a signal of the slide position sensor and the like, the die height adjustment can be performed during driving of the slide. Further, if the slide motion control is performed with the servo motor, the die height adjustment is performed during slide motion control by being linked with the servo motor for the slide motion control, thus making it possible to easily respond to the slide operation with higher stroke per minute, and perform a high-speed operation of the pressing machine.

BEST MODE FOR CARRYING OUT THE INVENTION

Preferred embodiments according to the present invention will be explained in detail below with reference to the drawings.

Figure 1:
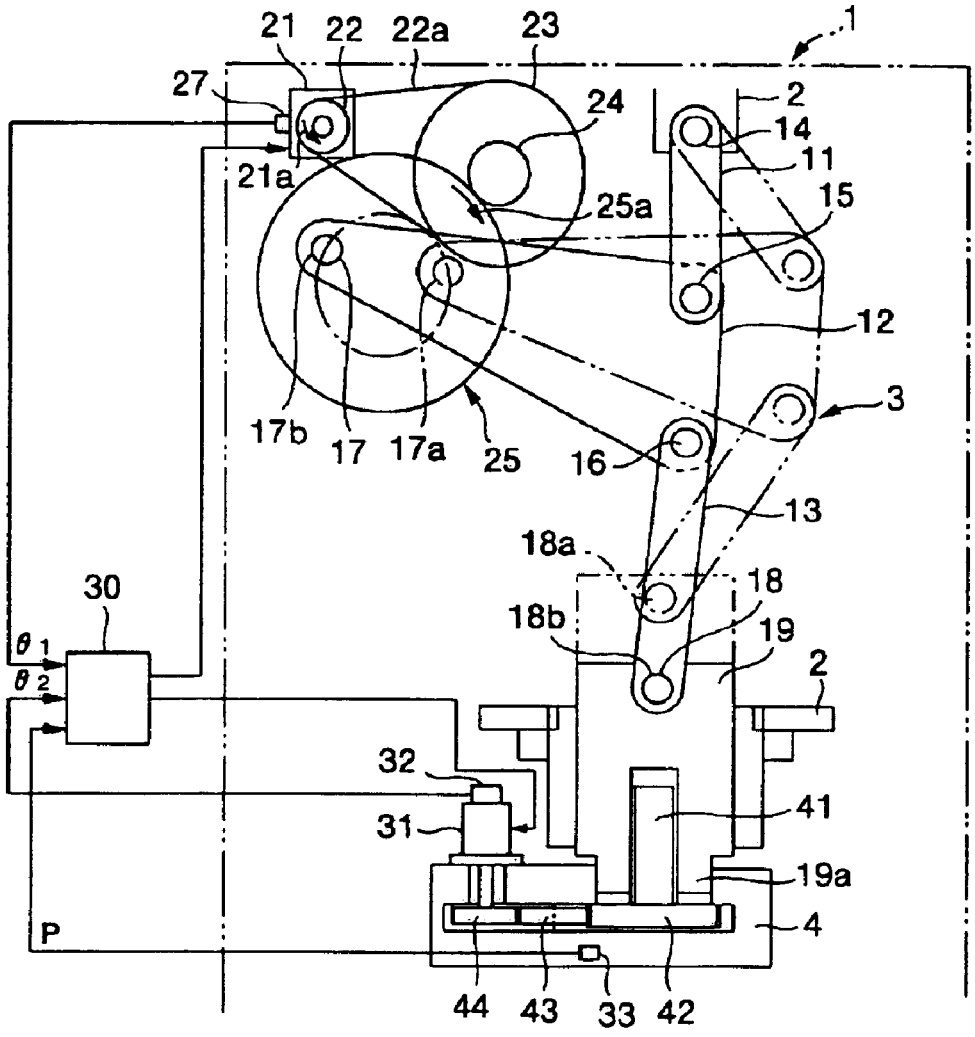
FIG. 1 is a schematic block diagram of a first embodiment of the present invention.

A first embodiment will be explained based on FIG. 1. FIG. 1 is a schematic block diagram of this embodiment. In FIG. 1, a slide 4 and a plunger 19 of a pressing machine 1 are both supported at a main body frame 2 to be vertically movable, and the slide 4 and the plunger 19 are fitted at a lower protruded portion 19*a* of the plunger 19 to be vertically slidable. A thread portion of an adjusting screw 41 provided at the slide 4 is screwed into a female screw portion formed in a lower part of the plunger 19. An upper part of the plunger 19 is connected to the main body frame 2 via a link mechanism 3. Namely, one end of a first link 11 is rotatably connected to an upper part of the main body frame 2 with a pin 14, the other end thereof is connected to one end of both end portions of one side of a triangle link 12. The other end of the both end portions of the aforementioned one side of the triangle link 12 is connected to one end of a second link 13 with a pin 16, and the other end of the second link 13 is connected to the upper part of the plunger 19 with a pin 18. The first link 11, the triangle link 12 and the second link 13 constitute a link mechanism 3.

A first pulley 22 is attached to an output shaft of a servo motor 21 for driving the slide (motion control). A timing belt 22*a* is placed across a second pulley 23 rotatably supported at the main body frame 2 and the first pulley 22. A first gear 24 is attached on the same axis as the second pulley 23, and a second gear 25 meshed with the first gear 24 is rotatably supported at the main body frame 2. A pin 17 on the other end, which opposes one side between the pins 15 and 16 of the triangle link 12 are rotatably connected to an eccentric position of the second gear 25. By controlling the rotation of the servo motor 21, an angle of rotation of the second gear 25 is controlled to reciprocate the plunger 19 and the slide 4 in the vertical direction via the link mechanism 3 such as the triangle link 12 and the like.

A gear 42 is attached at a lower end portion of the adjusting screw 41 provided at the slide 4, and the gear 42 is meshed with a pinion 44 attached to an output shaft of a servo motor 31 for adjusting die height, which is attached to the slide 4. Control command signals are inputted into the servo motor 21 for driving the slide (motion control) and the servo motor 31 for adjusting the die height, from a controller 30. Position detecting signals θ1 and θ2 of position sensors 27 and 32, which are provided at both the servo motors 21 and 31, are inputted into the controller 30. A load sensor 33 constituted by a strain sensor or the like is attached to the slide 4, and a load detection signal P of the load sensor 33 is inputted into the controller 30.

The controller 30 is constituted by a high-speed operation unit such as a microcomputer, a high-speed numeric operation processor, and has memory for storing predetermined control parameters, control target data and the like. For example, set means (not shown) for previously setting slide positions and slide speed in one cycle as a slide control pattern according to the types of machining for a work, work machining conditions and the like is included, the set slide control pattern is stored in the aforementioned memory. Here, as the types of machining for the work, there are molding, drawing, punching, marking and the like, and as the work machining conditions, there are plate thickness, molding shape, slide SPM and the like. Before a work is actually machined under the above-described set condition, precision of the product, which is previously machined by trial pressing, is measured, then a target load corresponding to a die height amount which makes optimal precision is obtained, and the target load is stored in the aforementioned memory.

Next, an operation at the time of driving the slide 4 via the link mechanism 3 will be explained.

When the servo motor 21 is rotated in the direction of the arrow 21*a* shown in the drawing, the speed is reduced via the pulleys 22 and 23 and the gears 24 and 25, and the pin 17 of the triangle link 12 is rotated in the direction of the arrow 25*a*. When the pin 17 is at a position 17*a* (corresponding to the triangle link 12 shown by the two-dot chain line), the position of the pin 18 at the upper part of the plunger 19 is set at a position 18*a* corresponding to a top dead center of the slide 4. When the pin 17 is at the position 17*b* (corresponding to the triangle link 12 shown by the solid line), the position of the pin 18 is set at a position 18*b* corresponding to a bottom dead center of the slide 4. Following the above-described rotation of the pin 17, the pin 18 reciprocates between the position 18*a* and the position 18*b*, whereby the plunger 19 and the slide 4 can reciprocate between the bottom dead center position and the top dead center position. By continuously rotating the servo motor 21 in the same direction, the slide 4 can be continuously operated.

Figure 2:
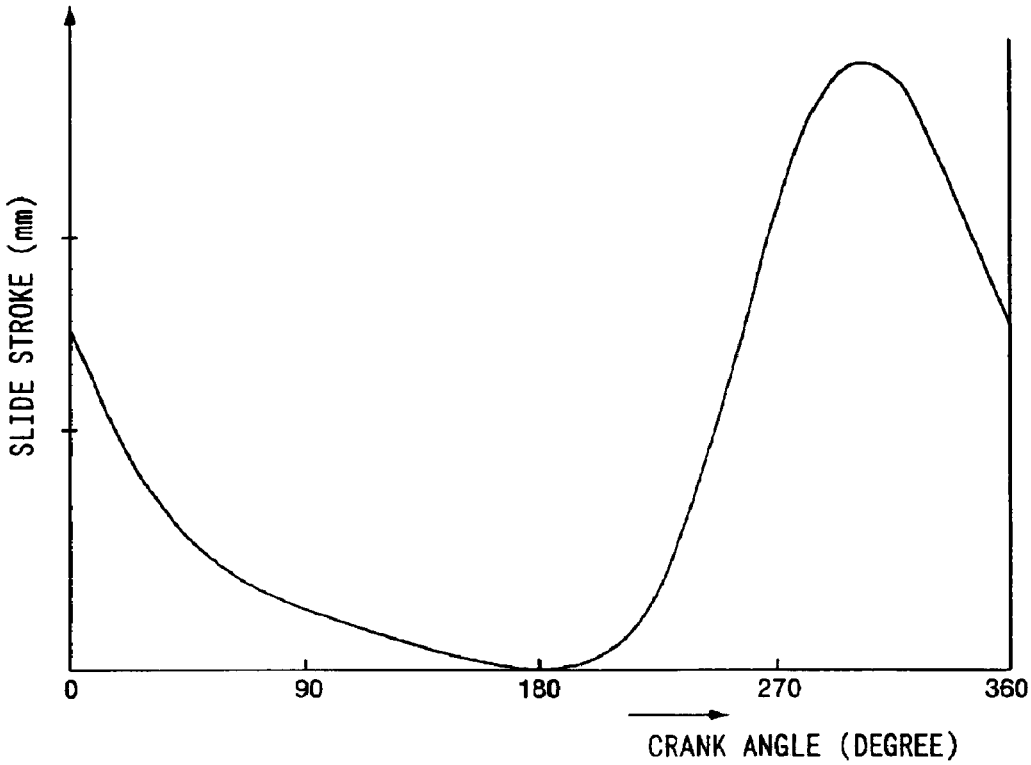
FIG. 2 is an example of slide motion of the first embodiment.

At the time of actual machining, the rotation angle and the speed of the servo motor is controlled by the controller 30 based on a previously set control pattern, whereby a slide motion corresponding to the pattern is realized. The slide motion is shown in, for example, FIG. 2. Here, in FIG. 2, a horizontal axis represents a crank angle in the control, a time axis of one cycle of the slide motion is shown by being brought into correspondence with 0 degree to 360 degrees of the crank angle in the conventional mechanical link press. A vertical axis represents a slide stroke (moving distance).

The controller 30 brings the horizontal axis of the slide motion to be controlled into correspondence with one cycle time corresponding to the slide SPM, and a slide stroke position corresponding to each point of the time axis in a uniform speed operation of the slide is obtained based on the above-described slide motion. Further, the controller 30 sets a motor rotation angle, which realizes the obtained slide stroke position, as a target position. Then, the controller 30 arithmetically operates a control command value, so that a deviation value between the target position and the position detection signal θ1 from the position sensor 27 becomes small, and the controller 30 controls the rotation angle of the servo motor 21 according to this control command value. Such a control is repeated for each cycle of the slide motion in succession, whereby motion is realized.

Meanwhile, when the servo motor 31 for adjusting the die height is rotated, the adjusting screw 41 is rotated via the pinion 44, and gears 43 and 42, and the slide 4 vertically moves, whereby the die height is adjusted. The adjustment of the die height is performed, following the procedure as shown in a flowchart in FIG. 3, for example.

Figure 3:
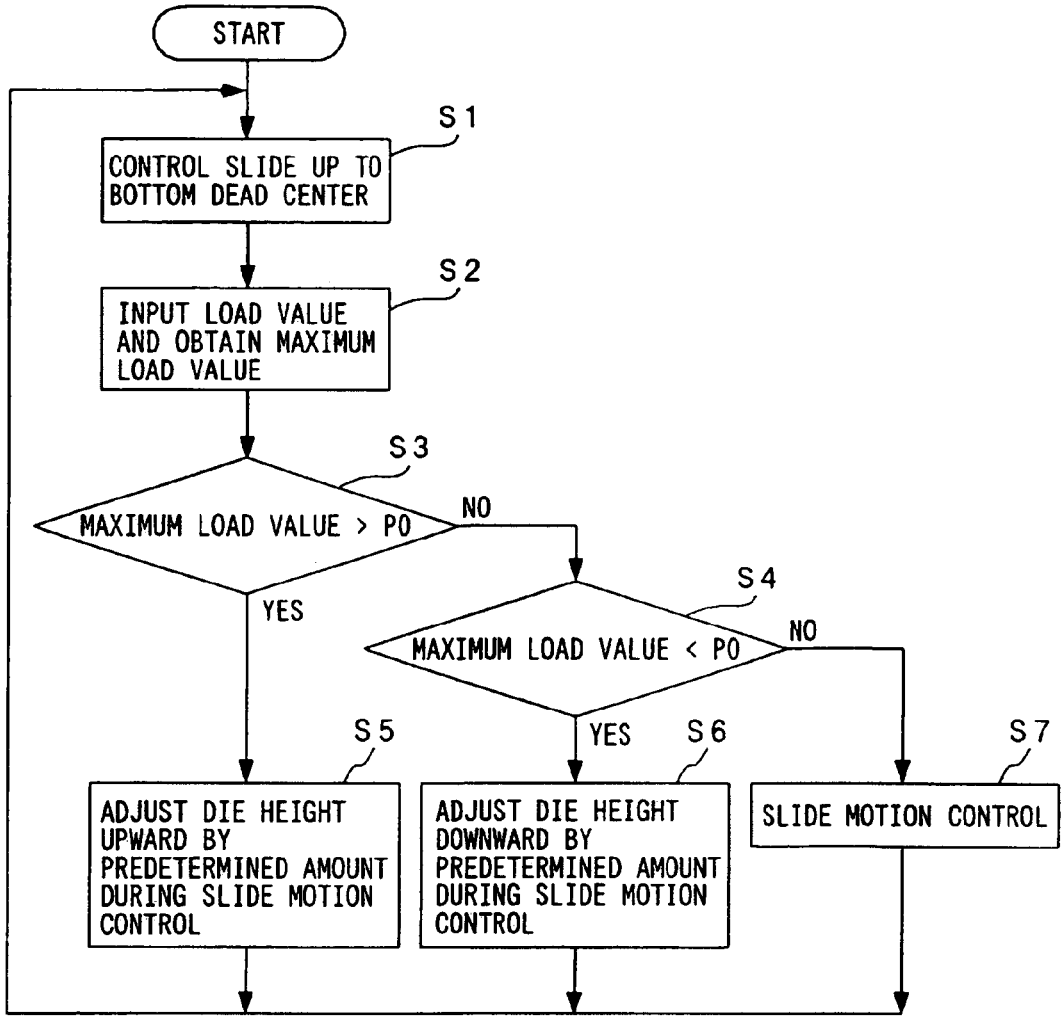
FIG. 3 is a flowchart of die height adjustment of the first embodiment.

In FIG. 3, in step S1, the slide 4 is controlled up to the bottom dead center by the servo motor 21 based on a slide motion previously set. In step 2, a load value at the time of pressurization is inputted from the load sensor 33, and a maximum load value Pmax at the slide stroke is obtained. Next, in step S3, it is checked whether or not the maximum load value Pmax is larger than a target load value P0 previously stored, and when it is larger, a command is given to proceed to step S5. In step S5, after the slide passes the bottom dead center, the slide 4 is controlled up to the top dead center by the servo motor 21 based on the aforementioned slide motion, and the die height is moved upward by a predetermined amount ΔH by the servo motor 31. Thereafter, a command is given to return to step S1 to repeat the above process.

When the maximum load value Pmax is the aforementioned target load value P0 or less in step S3, it is determined whether the maximum load value Pmax is smaller than the target load value P0 in step S4, and when it is smaller than the target load value P0, a command is give to proceed to step S6. In step S6, after the slide passes the bottom dead center, the slide 4 is controlled to move to the top dead center based on the aforementioned slide motion by the servo motor 21, and the die height is moved downward by the predetermined amount ΔH by the servo motor 31. Thereafter, the command is given to return to step S1 to repeat the above process. When the maximum load value Pmax is not smaller than the target load value P0 in step S4, namely, when both of them are equal, a command is given to proceed to step S7, and after the slide passes the bottom dead center, the slide 4 is controlled to move to the top dead center by the servo motor 21 based on the aforementioned slide motion, then a command is given to return to step S1 to repeat the above process.

According to the constitution and operation of the first embodiment as described above, the following effects are provided.

(1) Since a very small movement of the slide 4 for adjustment of the die height is controlled by the servo motor 31, the control responsiveness is very good, and thus positioning of a predetermined very small moving amount of the slide (1 μm to 5 μm) can be completed with high precision. Accordingly, the die height can be adjusted with high precision, and therefore product precision can be kept high.

(2) Since die height adjustment is performed by controlling the servo motor as in the above-described item (1), adjustment can be completed in a short time with excellent responsiveness, adjustment can be performed for each slide stroke even when the slide is driven at high stroke per minute (high speed SPM). Accordingly, the die height can be always adjusted to an optimal die height position, and highly precise products can be produced with stability without variations.

(3) In addition, during driving of the slide, namely, during the movement after passing the bottom dead center to a work contact position via the top dead center, the die height adjustment by the servo motor 31 is completed in a short time, and therefore the apparatus can also respond to machining at high stroke per minute. As a result, there is no inconvenience in operation and availability is extremely enhanced as compared with the apparatus, which performs die height adjustment while the slide stops.

(4) The die height is adjusted so that the load becomes the optimal load according to the work by monitoring the load value, and therefore the apparatus can be constructed at lower cost as compared with the apparatus which controls the die height by directly measuring it with a highly precise linear sensor or the like.

Figure 4:
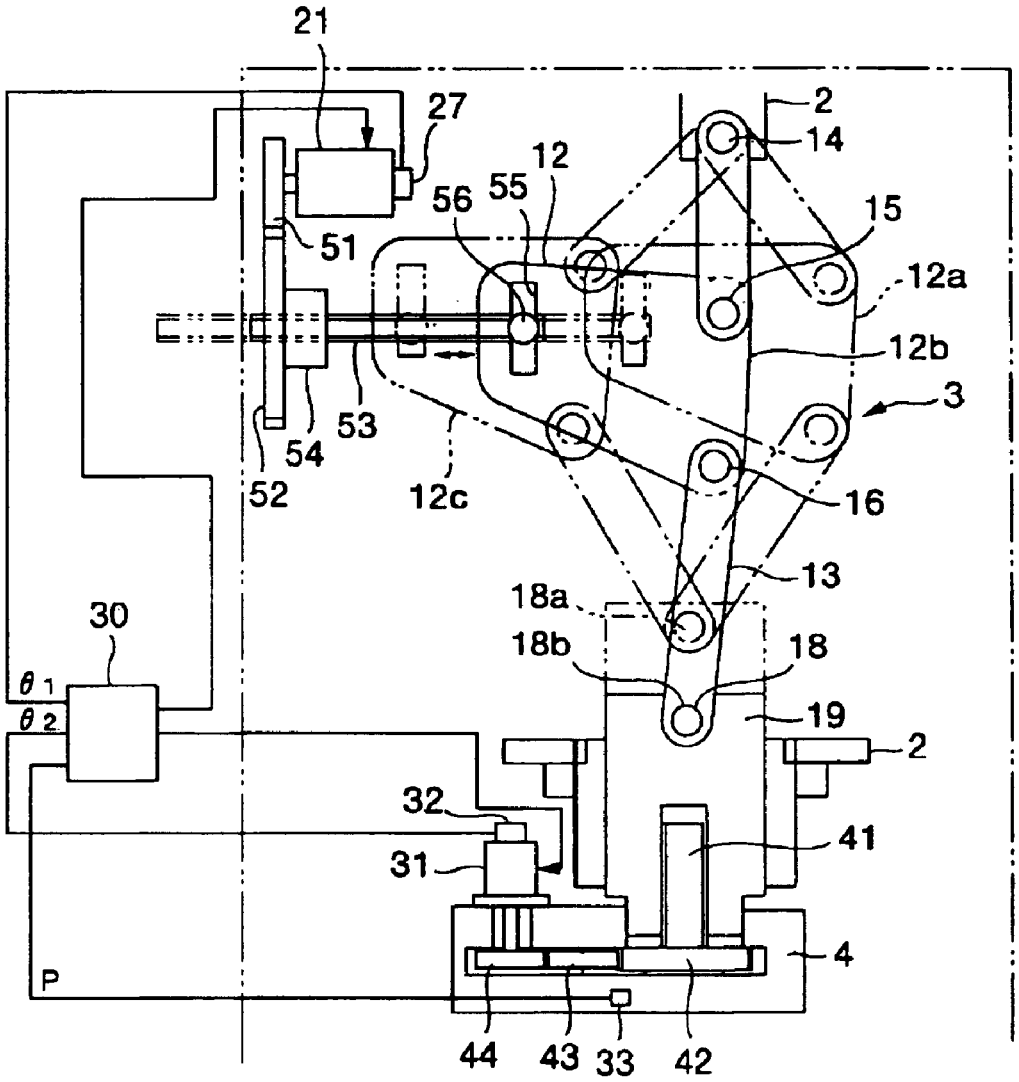
FIG. 4 is a schematic block diagram of a second embodiment of the present invention.

Next, a second embodiment will be explained based on FIG. 4. FIG. 4 is a schematic block diagram of a press drive apparatus of this embodiment, and the same components as in FIG. 1 are given the same reference numerals and symbols in FIG. 4, and the explanation will be omitted below. A pinion 51 attached to an output shaft of a servo motor 21 for driving a slide is meshed with a gear 52, and a nut member 54 is fixedly provided at an axis of the gear 52, the nut member 54 is rotatably supported at a main body frame 2. A ball screw 53 is screwed into the nut member 54 to be movable in the axial direction. A tip end portion of the ball screw 53 is caught by a long hole 55 longer in a perpendicular direction to the axis of the ball screw and an catching pin 56, which are formed at a triangle link 12 of a link mechanism 3, to be vertically slidable to be connected thereto.

Next, an operation of this embodiment will be explained with reference to FIG. 4. When the servo motor 21 is rotated, the nut member 54 is rotated via the gears 51 and 52. As a result, the ball screw 53 advances and retreats in the axial direction to push and pull the triangle link 12 to drive it in the arrow direction. The ball screw 53 is driven to reciprocate so that the triangle link 12 moves between a position 12*a* corresponding to a first top dead center of the slide 4 and a position 12*c* corresponding to a second top dead center via a position 12*b* corresponding to a bottom dead center. At this time, a moving amount in the vertical direction of the triangle link 12 is absorbed by the catching pin 56 vertically sliding inside the long hole 55. As a result, as in the case of the first embodiment, the plunger 19 and the slide 4 reciprocate between the top dead center and the bottom dead center via the pin 18 connected to the upper part of the plunger 19. Further, it is the same as in the first embodiment that the die height adjustment is performed by the servo motor 31.

The effects of the second embodiment is substantially the same as the first embodiment, but other than this, the second embodiment has the unique effects as follows.

(1) The ball screw 53 is driven to reciprocate in a horizontal direction to reciprocate the triangle link 12 between the two positions 12*a* and 12*c* that correspond to the top dead center with the position 12*b* corresponding to the bottom dead center between them, and therefore it is made possible to pass the bottom dead center twice by reciprocating drive of one cycle by the servo motor 21. As a result, twice as many as strokes per minute of the slide 4 with respect to the number of drive cycles of the servo motor 21 can be realized, and thus slide drive at high stroke per minute can be facilitated.

(2) Twice as many as strokes per minute can be realized as described above, thus making it possible to obtain the effect that it is effective because clear marking can be performed by double pressing in the case of, for example, coining work, and the like.

Figure 5:
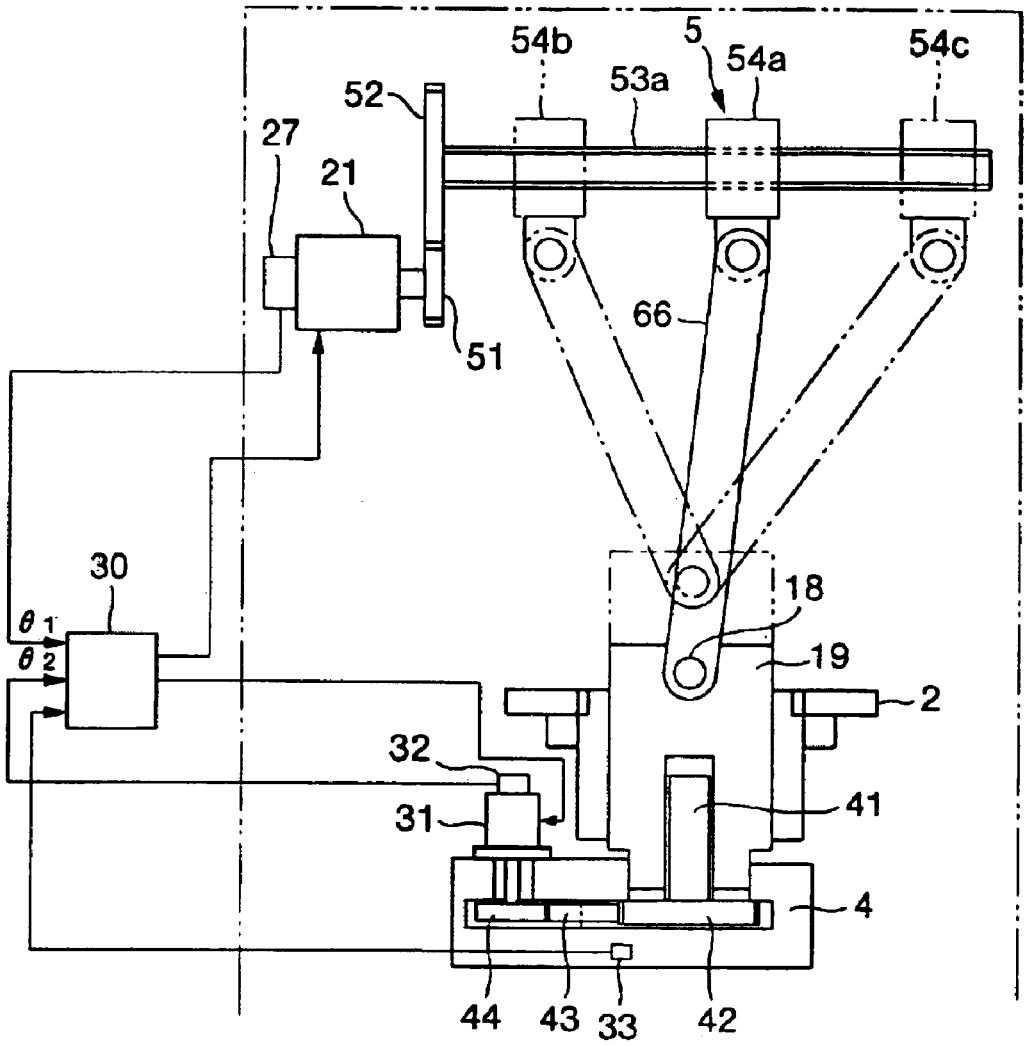
FIG. 5 is a schematic block diagram of a third embodiment of the present invention.

Next, a third embodiment will be explained base on FIG. 5. The same components as in FIG. 1 are given the same numerals and symbols, and the explanation thereof will be omitted here. A pinion 51 attached to an output shaft of a servo motor 21 is meshed with a gear 52, a ball screw 53*a* is attached at an axis of the gear 52, and a ball screw 53*a* is rotatably supported at a main body frame 2. A nut member 54*a* is screwed onto a ball screw 53*a* to be movable in an axial direction. An upper part of a link 66 is swingably connected to the nut member 54*a* with a pin, and an upper part of a plunger 19 is connected to a lower part of the link 66 with a pin 18. The ball screw 53*a*, the nut member 54*a* and the link 66 constitute a ball screw mechanism 5.

Here, an operation of the third embodiment will be explained. When the servo motor 21 is rotated, the ball screw 53*a* is rotated, and following this, the nut member 54*a* is moved in the axial direction (the horizontal direction in this example). The movement of the nut member 54*a* is converted into vertical movement by the link 66 to drive the plunger 19 and the slide 4 vertically. When the ball screw 53*a* is normally and reversibly rotated in a range of a predetermined rotational frequency, the nut member 54*a* reciprocates between predetermined positions 54*b* and 54*c*, and the plunger 19 and the slide 4 vertically moves via the link 66. When the predetermined positions 54*b* and 54*c* are set at the positions corresponding to two top dead centers as in the first and the second embodiments, the slide 4 vertically moves two strokes and passes the bottom dead centers twice for one cycle of reciprocation of the nut member 54*a*. It is the same as in the aforementioned embodiments that the servo motor 31 for adjusting the die height and the adjusting screw 41 are included.

The effects according to the third embodiment are the same as the second embodiment, and therefore the explanation will be omitted. In the second and the third embodiments, the slide 4 vertically moves two strokes for one cycle of reciprocation of the triangle link 12 or the nut member 54*a*, but this is not restrictive. For example, the triangle link 12 or the nut member 54*a* may be reciprocated between the position corresponding to the top dead center of the slide and the position corresponding to the bottom dead center, so that the slide 4 may vertically move one stroke for one cycle of reciprocation.

Figure 6:
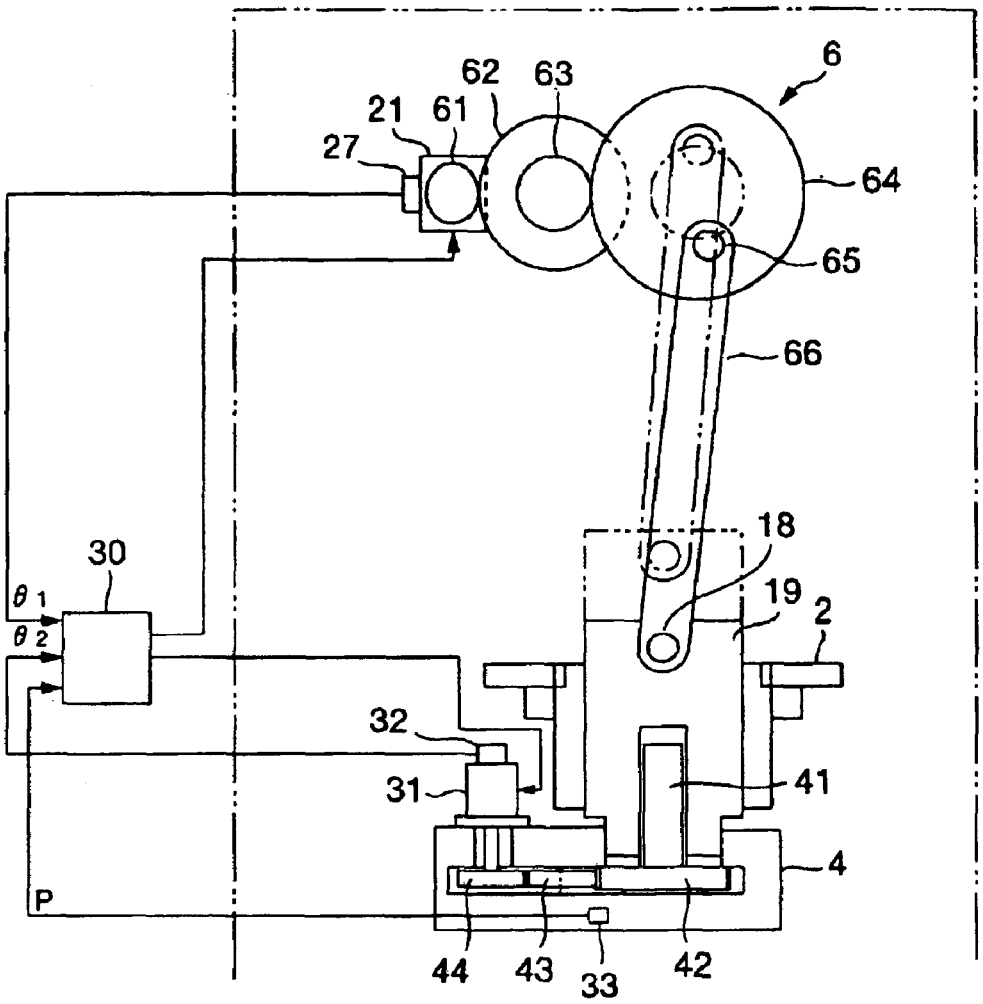
FIG. 6 is a schematic block diagram of a fourth embodiment of the present invention.
Figure 7:
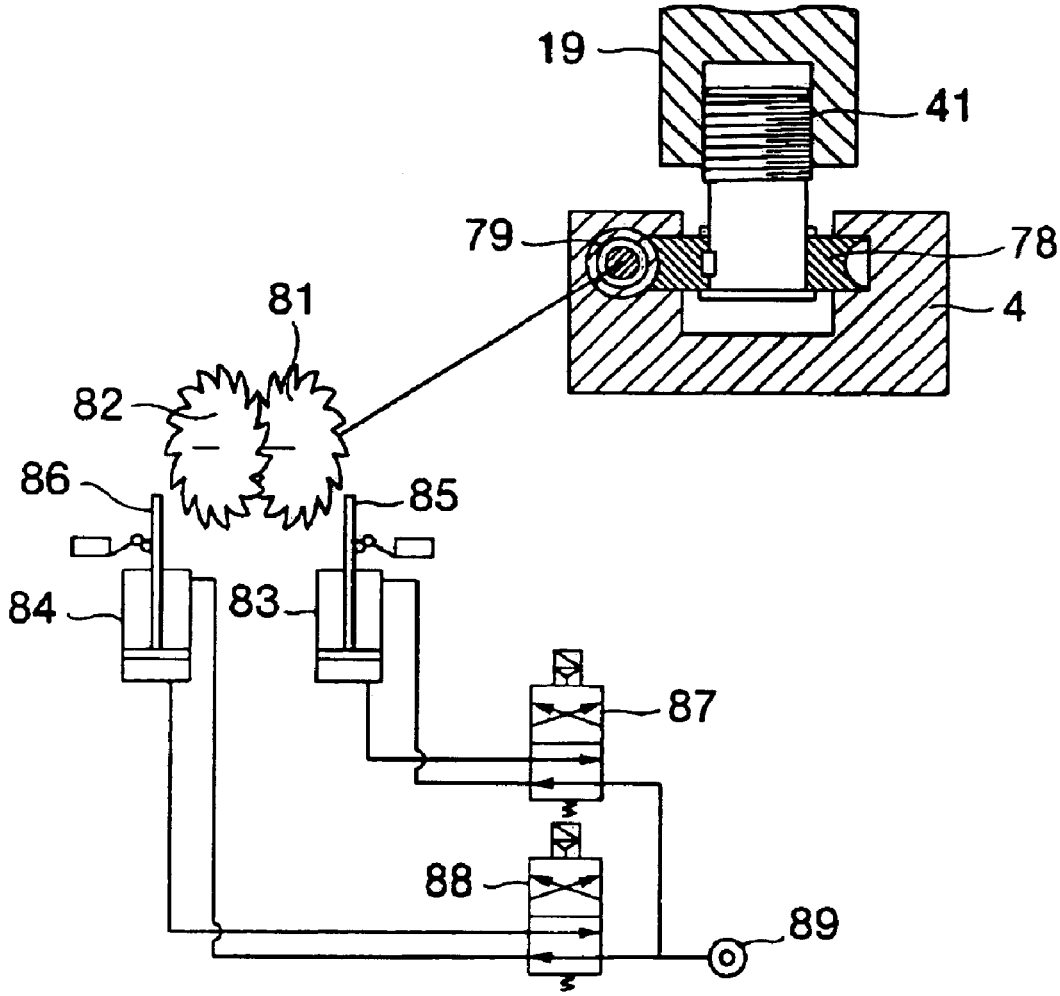
FIG. 7 Prior Art
FIG. 7 is a block diagram of a conventional die height adjusting apparatus.

Next, a fourth embodiment will be explained based on FIG. 6. In FIG. 6, a first pinion 61, which is attached to an output shaft of a servo motor 21 for driving a slide, is meshed with a first gear 62, and a second pinion 63 having the same axis is fixedly provided at a position of the axis of the first gear 62. A second gear 64 is meshed with the second pinion 63, and an upper part of a link 66 is swingably connected to the second gear 64 at an eccentric position with a pin 65. An upper part of the plunger 19 is connected to a lower part of the link 66 with a pin 18. As in the first embodiment, an adjusting screw 41 is screwed into the plunger 19, and a pinion 44, which is attached to an output shaft of a servo motor 31 for adjusting die height attached to the slide 4, is meshed with a gear 42 of the adjusting screw 41 via an intermediate gear 43. The gear 64, the pin 65 and the link 66 constitute an eccentric mechanism 6.

An operation of the fourth embodiment will be explained with reference to FIG. 6. When the servo motor 21 is rotated, the second gear 64 is rotated via the second pinion 63, and the link 66, which is eccentrically connected to the second gear 64 with the pin, and the plunger 19, which is connected to the link 66, reciprocate in the vertical direction, whereby the slide 4 reciprocates in the vertical direction. In this situation, by the continuous rotation in one direction of the servo motor 21, the slide 4 continuously reciprocates. It is the same as in the previous embodiments that the die height is adjusted via the adjusting screw 41 by the rotation of the servo motor 31. The effects according to the fourth embodiment is the same as the first embodiment, and therefore the explanation will be omitted.

As explained thus far, according to the present invention, the following effects are provided.

(1) Since the die height adjustment is performed by the control of the position of the servo motor, control responsiveness is very good, and the die height adjustment with high precision can be completed in a short time. Accordingly, press working with high product precision can be made even during an operation at high stroke per minute.

(2) As a result that the die height adjustment is performed by the control of the position of the servo motor, the die height adjustment can be performed without reducing stroke per minute even if the die height adjustment is performed during a slide motion control, for the reason of the above-described item (1). As a result, a pressing operation can be made at high stroke per minute, and excellent productivity is obtained. The control of the die height adjustment by the servo motor is linked with the slide motion control by the servo motor, and thus the control can be facilitated.

(3) Since the die height adjustment with the servo motor is performed for each slide stroke, pressing work can be always performed in a state in which the die height is kept highly precise, and thus the products with high precision can be surely produced without variations.

What is claimed is:

1. A slide drive apparatus for a pressing machine, comprising:

a slide;

a servo motor for controlling slide motion, wherein a rotation angle and speed of said servo motor are controlled to produce a desired slide motion;

a mechanical power transmission mechanism coupled to the servo motor for converting rotational power of said servo motor for controlling slide motion into vertical reciprocating motion of said slide;

a plunger incorporated in said power transmission mechanism and connected to said slide through an adjusting screw; and a servo motor for adjusting die height coupled to the adjusting screw, which performs die height adjustment of said slide through position control by rotating the adjusting screw to vary a spacing between said slide and said plunger; and a control unit for receiving a signal from a sensor which directly and constantly monitors a position of said slide so as to drive said servo motor for adjusting die height to accurately vary the spacing between said slide and said plunger.

2. The slide drive apparatus for the pressing machine according to claim 1, wherein the die height adjustment of said slide is performed for each slide stroke.

3. The slide drive apparatus for the pressing machine according to claim 1, wherein said power transmission mechanism comprises a link mechanism.

4. The slide drive apparatus for the pressing machine according to claim 1, wherein said power transmission mechanism comprises an eccentric mechanism.

5. The slide drive apparatus for the pressing machine according to claim 1, wherein said power transmission mechanism comprises a ball screw mechanism.

6. The slide drive apparatus for the pressing machine according to claim 1, wherein the die height adjustment of said slide is performed during a slide motion control of said servo motor for controlling slide motion.

7. The slide drive apparatus for the pressing machine according to claim 6, wherein the die height adjustment of said slide is performed for each slide stroke.

8. The slide drive apparatus for the pressing machine according to claim 6, wherein said power transmission mechanism comprises a link mechanism.

9. The slide drive apparatus for the pressing machine according to claim 6, wherein said power transmission mechanism comprises an eccentric mechanism.

10. The slide drive apparatus for the pressing machine according to claim 6, wherein said power transmission mechanism comprises a ball screw mechanism.

* * * * *